US010689234B2

(12) United States Patent
Yee

(10) Patent No.: US 10,689,234 B2
(45) Date of Patent: Jun. 23, 2020

(54) PULLEY SYSTEM WITH SAFETY LOCK

(71) Applicant: X Development LLC, Mountain View, CA (US)

(72) Inventor: Phillip Yee, San Francisco, CA (US)

(73) Assignee: X Development LLC, Mountain View, CA (US)

( * ) Notice: Subject to any disclaimer, the term of this patent is extended or adjusted under 35 U.S.C. 154(b) by 190 days.

(21) Appl. No.: 15/916,925

(22) Filed: Mar. 9, 2018

(65) Prior Publication Data

US 2019/0276286 A1 Sep. 12, 2019

(51) Int. Cl.
*B66D 3/10* (2006.01)
*B66C 13/04* (2006.01)

(52) U.S. Cl.
CPC ..... *B66D 3/10* (2013.01); *B66C 13/04* (2013.01)

(58) Field of Classification Search
CPC ..... B66D 3/08; B66D 3/10; B66C 13/04
See application file for complete search history.

(56) References Cited

U.S. PATENT DOCUMENTS 2,276,767 A * 3/1942 Dubuque ..... B66D 3/10 254/391
3,756,565 A * 9/1973 Sakai ..... B66D 3/10 254/391
4,055,290 A * 10/1977 Elsas ..... B65H 51/10 226/128
4,114,875 A * 9/1978 Deluty ..... A63B 21/018 188/65.1
4,533,026 A * 8/1985 Bernard ..... A62B 35/04 188/184
5,615,865 A * 4/1997 Fountain ..... B66D 3/10 254/269
5,845,894 A * 12/1998 Petzl ..... A62B 1/14 254/391
6,182,946 B1 * 2/2001 Rutherford ..... A01M 31/00 254/391
6,699,149 B1 * 3/2004 White ..... F16H 7/18 474/118
7,431,269 B2 * 10/2008 Carlson ..... B66D 3/04 254/405
7,438,281 B2 * 10/2008 Pesnel ..... B66D 3/04 254/393
7,658,264 B2 * 2/2010 Mauthner ..... A62B 1/14 182/5
7,913,980 B1 * 3/2011 Cipriano ..... B66D 3/08 248/218.4
8,210,502 B2 * 7/2012 Fogg ..... E21B 33/072 254/406
8,596,615 B2 * 12/2013 Kommer ..... B66D 3/10 254/391
8,733,739 B2 * 5/2014 Mauthner ..... A62B 1/14 254/391

(Continued)

FOREIGN PATENT DOCUMENTS

WO 2011/042571 4/2011

*Primary Examiner* — Emmanuel M Marcelo
(74) *Attorney, Agent, or Firm* — Fish & Richardson P.C.

(57) ABSTRACT

A pulley system includes a cord and a pair of stages coupled at a pivot point, the stages being independently rotatable about a stage axis. A first pulley is attached to the stages at the pivot point. Two additional pulleys are attached to one of the stages. Braking elements are attached to one of the stages and engage the cord when an uneven tension is applied.

13 Claims, 5 Drawing Sheets

(56) References Cited

U.S. PATENT DOCUMENTS

| | | | | |
|---|---|---|---|---|
| 2006/0017047 | A1* | 1/2006 | Calver | B66D 1/7415 254/411 |
| 2006/0070809 | A1* | 4/2006 | Barzilai | A62B 1/14 182/193 |
| 2008/0203371 | A1* | 8/2008 | Mauthner | B66D 3/04 254/391 |
| 2016/0243458 | A1* | 8/2016 | Heath | A63J 1/02 |

* cited by examiner

PULLEY SYSTEM WITH SAFETY LOCK

BACKGROUND

This specification relates generally to pulley systems and, more specifically, to safety mechanisms to address lifting cord failure in pulley systems.

Pulleys are used to lift an object attached to a cord (e.g., a cable, rope, wire, chain, string, or other cord) by translating a downward force applied to one end of the cord to an upward force on the object attached to the other end of the cord. If the lifting portion of the cord happens to be severed or released while lifting the object, a conventional pulley, with no built-in safety system, will allow the object to fall. This type of cord failure can not only cause damage to the object, but also harm those close to the object when it falls.

SUMMARY

Disclosed are pulley systems featuring safety mechanisms that address lifting cord failure. Among other advantages, embodiments feature a mechanical locking mechanism for a pulley that automatically locks a cord when failure occurs on either end of the cord.

In general, a first aspect features a pulley system for lifting a load using a cord. The pulley system includes a first stage and a second stage mechanically coupled to the first stage at a pivot point, the first and second stages being independently rotatable about a stage axis passing through the pivot point. The pulley system also includes a first pulley attached to the first stage and the second stage at the pivot point, the first pulley being rotatable about a first pulley axis coinciding with the stage axis. Additionally, the pulley system includes a second pulley attached to the second stage, the second pulley being rotatable about a second pulley axis parallel to but displaced from the stage axis. The pulley system also includes a third pulley attached to the second stage, the third pulley being rotatable about a third pulley axis parallel to but displaced from the stage axis and the second pulley axis. The pulley system further includes a pair of braking elements attached to the first stage, a first of the braking elements being positioned between the first and second pulleys and a second of the braking elements being positioned between the first and third pulleys. With respect to the pulley system, an even tension on the cord aligns the first stage and the second stage in a neutral arrangement in which both braking elements are disengaged from the cord, and an uneven tension on the cord rotates the first stage with respect to the second stage about the stage axis so that the first braking element engages the cord at the second pulley or the second braking element engages the cord at the third pulley.

Implementations of the electronic display can include one or more of the following features and/or one or more features of other aspects. For example, the pulley system can also include a pair of guide elements attached to the first stage defining a channel for the cord. The first, second, and third pulleys and the pair of guide elements can define a path for the cord in a plane perpendicular to the stage axis extending from the channel to the second pulley, from the second pulley to the first pulley, from the first pulley to the third pulley, and from the third pulley to the channel. The pulley system can also include a guide element attached to the second stage and positioned in the channel defined by the pair of guide elements. The pair of guide elements attached to the first stage and the guide element attached to the second stage can be cylindrically-shaped guide elements, each having a corresponding cylinder axis parallel to the first pulley axis. The cord path of the pulley system can extend on either side of the guide element attached to the second stage.

In some implementations, the first stage includes a suspension point for fastening to a suspension cable. The suspension point, stage axis, and channel defined by the pair of guide elements can lie along a common line. The common line can be in a vertical direction when the pulley system is suspended from the suspension point.

In addition, the first and second pulley axes can define a horizontal line when the pulley system is suspended from the suspension point.

In other implementations, the second and third pulleys can have the same diameter. The first pulley can also have the same diameter as the second and third pulleys.

Additionally, the braking elements can each include teeth arranged to engage the cord when the corresponding braking element engages the cord.

The pulley system can also include a rope, a cable, a chain, a wire, or a string.

DETAILED DESCRIPTION

Figure 1A:
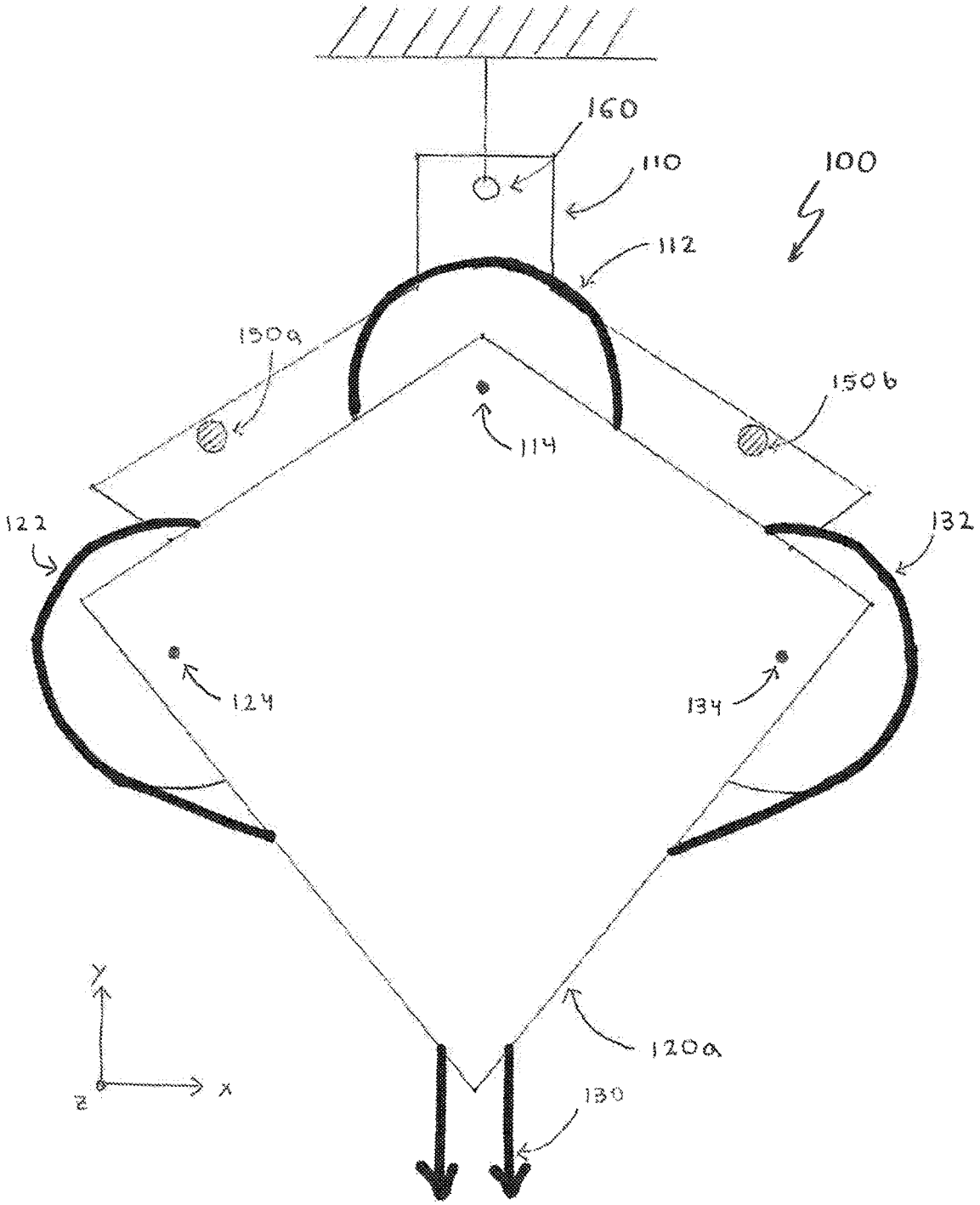
FIG. 1A shows, in plan view, an embodiment of a pulley system that includes a locking mechanism and a frontmost stage.
Figure 1B:
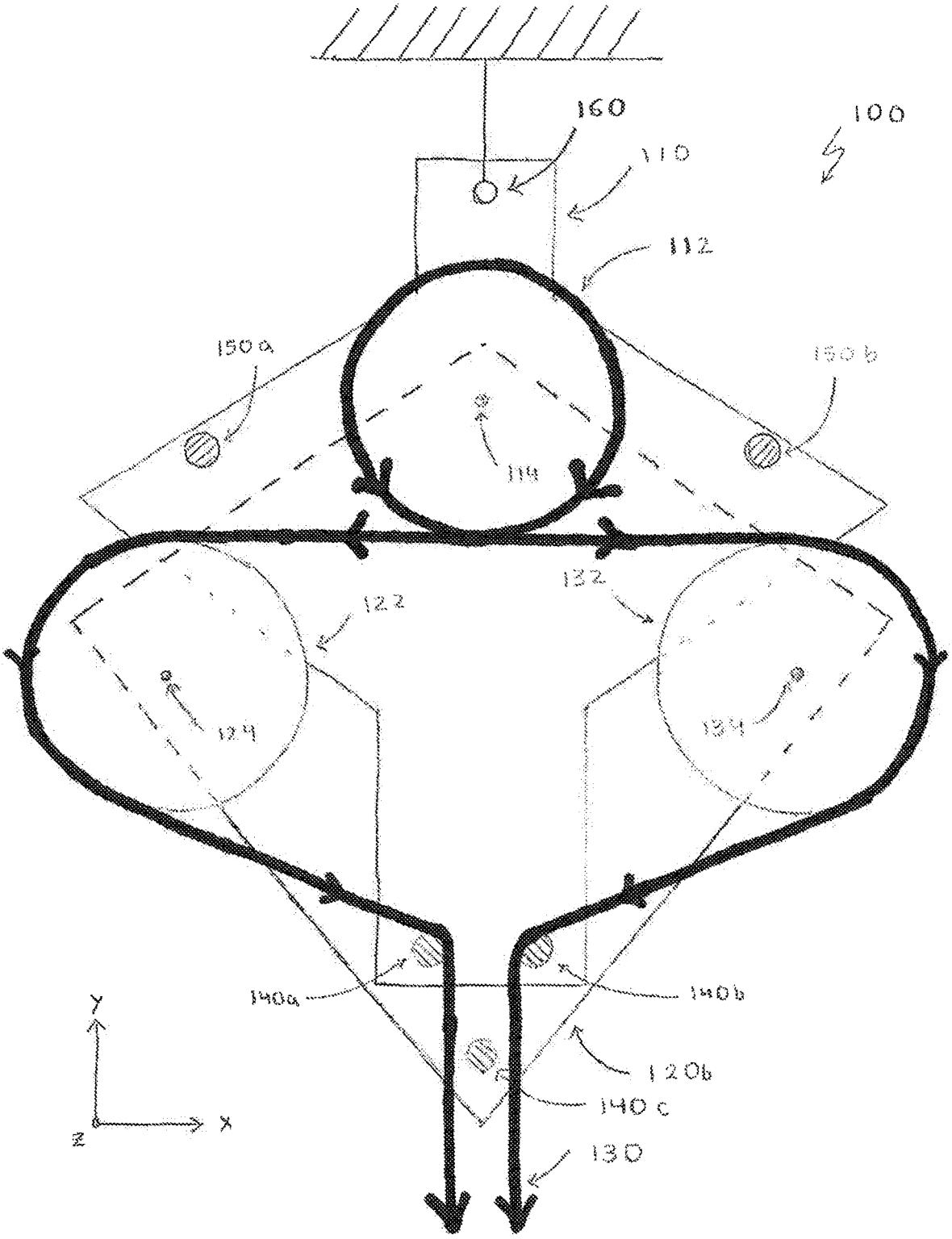
FIG. 1B shows, in plan view, the embodiment of the pulley system shown in FIG. 1A with the frontmost stage removed to show additional detail.

FIGS. 1A and 1B show, in plan view, a pulley system 100 that features a locking mechanism. Pulley system 100 includes a first stage 110, a pair of kite-shaped stages, i.e., second stage 120*a* and second stage 120*b*, and three pulleys 112, 122, and 132 arranged between the first stage 110 and the second stage 120*a*. As illustrated in FIG. 1A, second stage 120*a* is in front of second stage 120*b*. Because the two stages share the same shape and are joined to first stage 110 by the same axis, axis 114, second stage 120*a* obscures second stage 120*b* in FIG. 1A. In FIG. 1B, stage 120*a* is omitted, providing an un-obscured view of the other components. For ease of reference, a three-dimensional Cartesian coordinate system is provided with X and Y axes in line with the page and Z-axis perpendicular to the page.

In FIGS. 1A and 1B, pulley system 100 and a cord 130 are in a neutral configuration. The pulley system 100 is in the neutral configuration as a result of equal downward forces being applied to both ends of cord 130.

Pulley system 100 is suspended from a suspension point 160, to which a suspension cable can be attached and anchored to a stable structure. Under the force of gravity, pulley system 100 hangs from the stable structure, as shown in FIG. 1A.

First stage 110 and second stages 120*a* and 120*b* each extend primarily in the X-Y plane and have a height that extends in the Z-direction, having parallel front and rear surfaces. More generally, provided the stage surfaces do not hinder their relative motion (described below), the surfaces need not be parallel to one another.

Each of the pulleys 112, 122, and 132 rotate both clockwise and counter-clockwise about a corresponding axis 114, 124, and 134, respectively. Axes 114, 124, and 134 extend in the Z-direction and are all parallel to one another. From the front to the back of pulley system 100, axis 114 passes through second stage 120*a*, pulley 112, first stage 110, and second stage 120*b*. Similarity, axes 124 and 134 pass through second stage 120*a*, pulleys 122 and 132, respectively, as well as through second stage 120*b*.

Axis 114 serves as a fulcrum for the pulley system. While the position of first stage 110 remains mostly fixed within the X-Y plane, second stages 120*a* and 120*b* can rotate together about axis 114. Pulley 112 is rotatably attached to first stage 110 and second stages 120*a* and 120*b* at axis 114. Pulleys 122 and 132 are rotatably attached to second stages 120*a* and 120*b* at axes 124 and 134.

Pulley system 100 is used to raise or lower a load using cord 130, which loops partially around pulleys 122 and 132, and loops completely around pulley 112. Because cord 130 loops completely around pulley 112, at the lowest point of pulley 112, with regard to the Y-direction, two portions of cord 130 are adjacent to one another. The portion of cord 130 below the cord's contact with guiding element 140*a* is referred to as the left hanging portion of cord 130, while the portion below the cord's contact with guiding element 140*b* is referred to as the right hanging portion of cord 130.

First stage 110 includes guiding elements 140*a* and 140*b*. These elements define a channel through which the two hanging portions of cord 130 are threaded. In this embodiment, guiding elements 140*a* and 140*b* are cylindrical components that extend in the Z-direction from the front surface of first stage 110. In other embodiments, guiding elements 140*a* and 140*b* can have different geometries, so long as they are able to provide a channel for cord 130. For example, guiding elements 140*a* and 140*b* can be either solid or hollow or rotatably attached to first stage 110 at two separate axes.

Furthermore, guiding elements 140*a* and 140*b* are symmetric to one another about an axis of symmetry that extends in the Y-direction through axis 114. In other embodiments, guiding elements 140*a* and 140*b* can be asymmetric to one another about the axis of symmetry. In other embodiments, guiding elements 140*a* and 104*b* can be omitted from pulley system 100.

Second stage 120*b* includes guiding element 140*c*. Guiding element 140*c* ensures that the two hanging portions of cord 130 do not becoming intertwined with one another. This element can be identical in form and structure to guiding elements 140*a* and 140*b*.

First stage 110 also includes braking elements 150*a* and 150*b*, which engage and brake cord 130 when a differential force on the cord exceeds a certain threshold (described below). In this embodiment, braking elements 150*a* and 150*b* are cylindrical components that extend in the Z-direction from the front surface of first stage 110. In other embodiments, these elements can have a different geometry so long as the braking elements, when engaged, are able to prevent cord 130 from moving. For example, braking elements 150*a* and 150*b* can be either solid or hollow or have ridges (e.g., teeth) to better allow the element to grip cord 130. In some embodiments, pulley system 100 can include more than two braking elements.

Figure 1C:
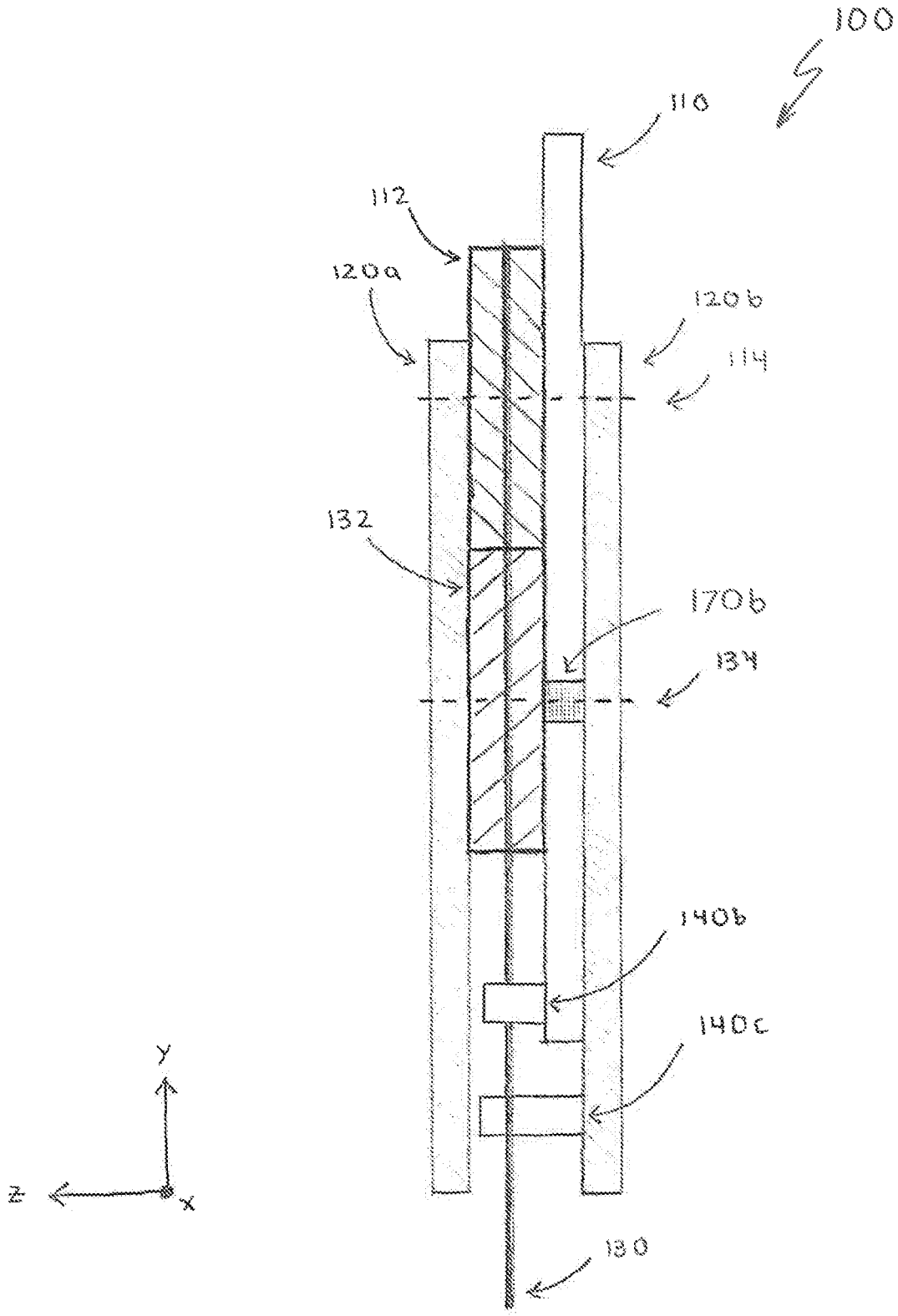
FIG. 1C shows a side view of the pulley system shown in FIG. 1A.

FIG. 1C shows a side view of the pulley system shown in FIGS. 1A and 1B. A dashed line is used to show axes 114 and 134. In addition to a plurality of the components discussed with regard to FIGS. 1A and 1B, FIG. 1C also shows a spacer 170*b*. Spacer 170*b* positions pulley 132 in the Z-direction so that the pulley is in line with pulley 112. Although obscured by spacer 170*b*, pulley system 100 also includes a similar spacer 170*a* which serves the same function as spacer 170*b* but is positioned between pulley 122 and second stage 120*b*. Spacers 170*a* and 170*b* are attached to pulley system 100 by axes 124 and 134, respectively. In this embodiment, spacers 170*a* and 170*b* are cylinders, although other geometries are possible so long as they are able to provide a space between pulleys 122 and 132 and second stage 120*b*.

In general, the components of pulley system 100 can be constructed of any material, or combination of materials, that have suitable mechanical properties and can be formed into the appropriate shapes. Generally, materials used should be sufficiently rigid to bear stresses associated with the use of the pulley system. For example, the components can be made of metal, plastic, wood, or a combination of these materials. Similarly, cord 130 can be any of a variety of suitable cords, such as a rope, a cable, a chain, a wire, or a string. As such, cords can be formed from metals, natural materials such as cotton, coir, hemp, henequen, jute, and sisal, as well as synthetic materials such as aramid, nylon, polyester, and polypropylene.

As illustrated in FIGS. 1A and 1B, pulley system 100 is in a neutral configuration, suspended under gravity with equal tension on both sides of cord 130. Under such circumstances, pulleys 122 and 132 remain symmetric with respect to pulley 112 and cord 130 remains stationary.

When a differential tension is applied to cord 130, (i.e., when a different downward force is applied to the two ends of cord 130), the differential tension causes the cord to move and to rotate the pulleys about their respective axes. In addition, stages 120*a* and 120*b* rotate relative to stage 110 about axis 114. However, provided the differential tension does not exceed a certain threshold, cord 130 is free to move. Under these circumstances, a user can raise or lower a load using pulley system 100 by attaching the load to one end of the cord and then raising or lowering the load by applying an appropriate force to the other end of the cord.

The degree to which second stages 120*a* and 120*b* rotate relative to axis 114 depends on whether the difference in applied force is sufficient to cause either braking element 150*a* or 150*b* to contact cord 130. When cord 130 contacts either braking element, cord 130 is pinched between the braking element and its adjacent pulley, and second stages 120*a* and 120*b* can no longer rotate. Braking element 150*a* or 150*b* is said to be "engaged" when it makes contact with either pulley 122 or 132, respectively. The difference in forces required to engage braking element 150*a* or 150*b* is referred to as a threshold force of pulley system 100, or simply the threshold force.

In general, the threshold force can vary depending on the nature of the use of the pulley. Generally, the threshold force will be larger where larger loads are expected. For relatively modest loads, the the threshold force can be 50 N or less (e.g., 20 N or less, 10 N or less, 5 N or less). A larger threshold force is also possible (e.g., more than 50 N, such as 100 N or more, 1 kN or more, 2 kN or more, 5 kN or more, 10 kN or more).

As an example of when the difference in downward forces applied to the two ends of cord 130 is less than the threshold force, consider when the pulley system has a load attached to the right hanging portion of cord 130. The attached load results in a downward force on the right hanging portion, which corresponds to the weight of the attached load. At the left hanging portion, a downward force can be applied that is exactly equal to the weight of the load (e.g., by a user pulling downwards on the left hanging portion). In this example, the difference in forces applied to each end of cord 130 is zero. Therefore, cord 130 does not move, and the attached load remains stationary.

Not only can pulley system 100 allow an attached load to remain stationary while the difference in downward forces applied to the two ends of cord 130 is less than the threshold force, it can also allow the load to ascend. As an example, a load can be attached to the right hanging portion of cord 130. At the left hanging portion, a downward force can be applied that is greater than the weight of the load. While the difference between the forces on the right and left hanging portions is less than the threshold force, cord 130 is able to move as a result of unequal forces being applied to its ends. As a result of a greater force being applied to the left hanging portion compared to the force on the right hanging portion, the cord moves so as to allow the load to ascend.

In addition to allowing an attached load to ascend while difference in downward forces applied to the two ends of cord 130 is less than the threshold force, pulley system 100 can also allow the load to descend. For example, a load can be attached to the right hanging portion of cord 130. At the left hanging portion, a downward force can be applied that is less than the weight of the load. While the difference between the forces on the right and left hanging portions is less than the threshold force, cord 130 can move. As a result of a greater force being applied to the right hanging portion, when compared to the force on the left hanging portion, the cord moves so as to allow the load to descend.

Figure 2:
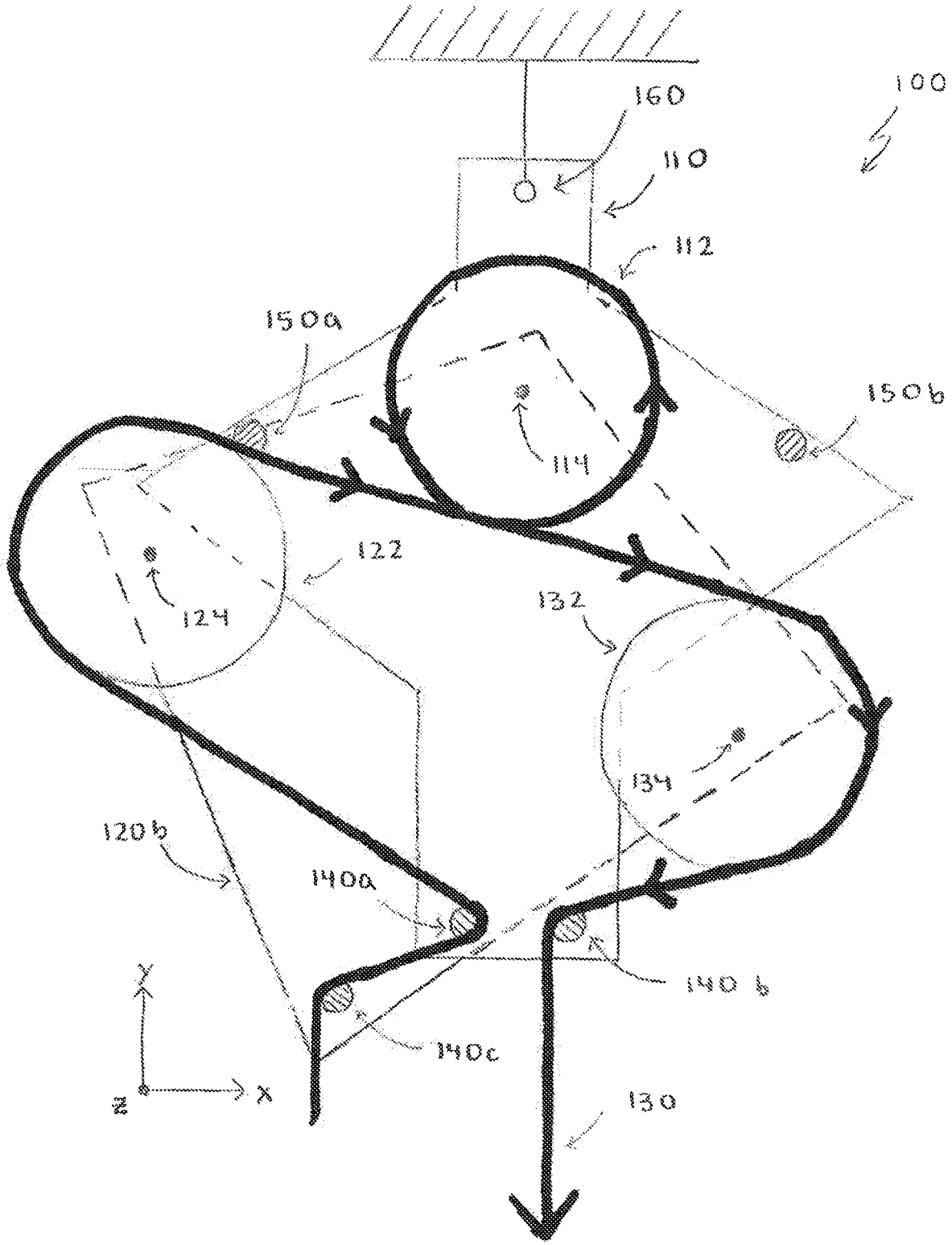
FIG. 2 shows a first braking configuration of the pulley system shown in FIGS. 1A-1C.

When the difference in downward forces applied to the two ends of cord 130 is less than the threshold force, a weight attached to one of the hanging portions of pulley system 100 can be raised or lowered according to the force applied to the other hanging portion, which is also referred to as the "lifting portion". In addition to allowing cord 130 to move while the difference in downward forces applied to the two ends of cord 130 is less than the threshold force, pulley system 100 can also transition to a braking configuration in which cord 130 is not able to move. Unequal forces on the hanging portions of cord 130 cause second stages 120*a* and 120*b* to rotate relative to axis 114. Second stages 120*a* and 120*b* are able to rotate through a certain arc before either pulley 122 or 132 makes contact with braking element 150*a* or 150*b*, respectively. FIG. 2 shows a braking configuration of pulley system 100 in which the right hanging portion of cord 130 has a greater downward force applied to it than does the left hanging portion, or lifting portion, of the cord.

FIG. 2 illustrates a scenario in which a weight is attached to the right hanging portion, while the left hanging portion, or lifting portion, has no force applied to it. The lifting portion can have no force applied to it as a result of it being severed, leading the cord to be divided into two or more parts. One part is engaged in pulley system 100, while the remaining severed parts are not. The lifting portion can also have no force applied to it as a result of it being released by a lifter, such as a human or a machine.

Although not shown in FIG. 2, the following description references second stage 120*a*, which is removed to show detail. In FIG. 2, the difference in forces between the right hanging portion and the lifting portion is greater than a threshold force of pulley system 100. Because of this, second stages 120*a* and 120*b* rotate clockwise, with respect to first stage 110, until braking element 150*a* is engaged by pulley 122. With braking element 150*a* engaged, cord 130 is prevented from moving and similarly, the attached weight does not move. Whereas a conventional pulley system with a severed or released lifting portion allows an attached weight to fall, pulley system 100 locks cord 130 preventing the attached weight from falling.

Figure 3:
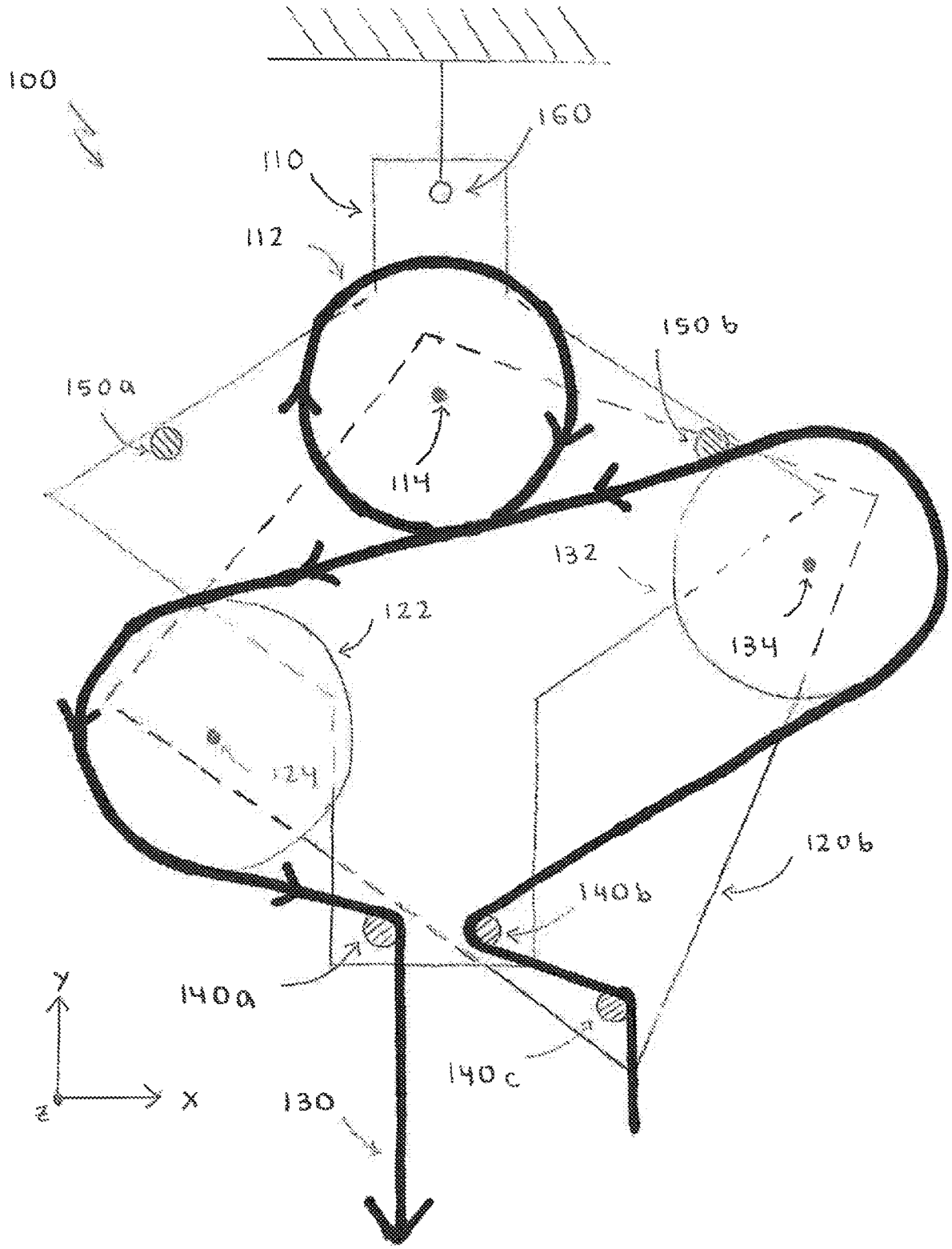
FIG. 3 shows a second braking configuration of the pulley system shown in FIGS. 1A-1C.

FIG. 2 illustrates one braking configuration of pulley system 100, in which greater force is applied to the right hanging portion compared to the force on the left hanging portion. Because of the symmetry of pulley system 100, a second braking configuration is possible, in which a greater force is applied to the left hanging portion compared to the force on the right hanging portion. FIG. 3 shows a braking configuration of the pulley system in which a left hanging portion of the cord has a greater downward force applied to it than does a right hanging portion, or lifting portion, of the cord. Again, while not explicitly shown in FIG. 3, the following description references second stage 120*a*, which is removed to show detail.

In FIG. 3, the left hanging portion of cord 130 has an attached weight, while the right hanging portion, or lifting portion, has no force applied to it, as a result of being severed or released. In addition, the difference in forces between the left hanging portion and the lifting portion is greater than a threshold force of pulley system 100. The difference in force causes second stages 120*a* and 120*b* to rotate counterclockwise with respect to first stage 110. Second stages 120*a* and 120*b* rotate counterclockwise until pulley 132 engages braking element 150*b*. Once engaged, braking element 150*b* prevents cord 130 from moving. Because cord 130 is unable to move, the attached weight is also prevented from moving.

A number of embodiments have been described. However, other implementations are also possible. For example, while the braking elements in pulley system 100 engage by pinching cord 130 between the braking element and a corresponding pulley, in other implementations, the braking elements can engage by contacting the pulley (e.g., in addition to or without contacting cord 130) and breaking the cord by preventing rotation of the pulley.

Other embodiments are in the following claims.

What is claimed is:

1. A pulley system for lifting a load using a cord, the pulley system comprising:

a first stage;

a second stage mechanically coupled to the first stage at a pivot point, the first and second stages being independently rotatable about a stage axis passing through the pivot point;

a first pulley attached to the first stage and the second stage at the pivot point, the first pulley being rotatable about a first pulley axis coinciding with the stage axis;

a second pulley attached to the second stage, the second pulley being rotatable about a second pulley axis parallel to but displaced from the stage axis;

a third pulley attached to the second stage, the third pulley being rotatable about a third pulley axis parallel to but displaced from the stage axis and the second pulley axis;

a pair of braking elements attached to the first stage, a first of the braking elements being positioned between the first and second pulleys and a second of the braking elements being positioned between the first and third pulleys; and wherein an even tension on the cord aligns the first stage and the second stage in a neutral arrangement in which both braking elements are disengaged from the cord, and an uneven tension on the cord rotates the first stage with respect to the second stage about the stage axis so that the first braking element engages the cord at the second pulley or the second braking element engages the cord at the third pulley.

2. The pulley system of claim 1, further comprising a pair of guide elements attached to the first stage defining a channel for the cord, wherein the first, second, and third pulleys and the pair of guide elements define a path for the cord in a plane perpendicular to the stage axis extending from the channel to the second pulley, from the second pulley to the first pulley, from the first pulley to the third pulley, and from the third pulley to the channel.

3. The pulley system of claim 2, further comprising a guide element attached to the second stage and positioned in the channel defined by the pair of guide elements.

4. The pulley system of claim 3, wherein the pair of guide elements attached to the first stage and the guide element attached to the second stage are cylindrically-shaped guide elements, each having a corresponding cylinder axis parallel to the first pulley axis.

5. The pulley system of claim 3, wherein the cord path extends on either side of the guide element attached to the second stage.

6. The pulley system of claim 2, wherein the first stage comprises a suspension point for fastening to a suspension cable.

7. The pulley system of claim 6, wherein the suspension point, stage axis, and channel defined by the pair of guide elements lie along a common line.

8. The pulley system of claim 7, wherein the common line is in a vertical direction when the pulley system is suspended from the suspension point.

9. The pulley system of claim 6, wherein the first and second pulley axes define a horizontal line when the pulley system is suspended from the suspension point.

10. The pulley system of claim 1, wherein the second and third pulleys have the same diameter.

11. The pulley system of claim 10, wherein the first pulley has the same diameter as the second and third pulleys.

12. The pulley system of claim 1, wherein the braking elements each comprise teeth arranged to engage the cord when the corresponding braking element engages the cord.

13. The pulley system of claim 1, wherein the pulley system further comprises a rope, a cable, a chain, a wire, or a string.

* * * * *